United States Patent [19]

Cziraki

[11] 4,193,508

[45] Mar. 18, 1980

[54] CAP REMOVER AND CLOSURE

[76] Inventor: Imre Cziraki, 15611 Sunflower La., Huntington Beach, Calif. 92647

[21] Appl. No.: 791,138

[22] Filed: Apr. 26, 1977

[51] Int. Cl.[2] ..... B65D 45/32

[52] U.S. Cl. ..... 215/226; 215/272; 215/274; 220/321

[58] Field of Search ..... 215/226, 228, 246, 275, 215/272, 304; 220/321

[56] References Cited

U.S. PATENT DOCUMENTS

| | | | |
|---|---|---|---|
| 1,165,131 | 12/1915 | Rossuck | 215/272 |
| 1,187,013 | 6/1916 | Schultz | 215/272 |
| 2,132,775 | 10/1938 | Casablancas | 215/272 |

FOREIGN PATENT DOCUMENTS

| | | | |
|---|---|---|---|
| 626658 | 10/1961 | Italy | 215/226 |
| 171669 | 12/1934 | Switzerland | 215/272 |

*Primary Examiner*—Joseph Man-Fu Moy
*Attorney, Agent, or Firm*—Victor C. Muller

[57] ABSTRACT

Combined crown cap remover and replacement closure for same, characterized by a cap remover and replacement closure pivotally connected together and movable between two limit positions. When in one limit position the closure provides a lever extension for the cap remover and when the cap remover is pivoted toward the other limit position it cammingly engages the closure to contract it into sealing engagement with the end of a container neck of the type having an encircling ridge adjacent the end thereof.

3 Claims, 8 Drawing Figures

CAP REMOVER AND CLOSURE

BACKGROUND OF THE INVENTION

It is a well known practice to reseal beverage and other bottles, particularly when they are carbonated, to preserve unused contents for future use. Various types of expandible stoppers have been employed for this purpose and presently plastic caps which engage the bottle neck are in wide use. Cap removing devices are also in wide use which generally comprise a lever with a projection to engage beneath the crown edge and a suitable abutment which engages the top of the cap to provide a fulcrum point. The cap is usually distorted during removal so that it may not be reused. Thus, the conventional procedure is to provide a cap removing device and a separate closure adapted to replace the original crown cap. These separate devices have also been combined by attaching the replacement cap to the cap opener which thus provides a device which serves both purposes.

SUMMARY OF THE INVENTION

The present invention relates to the general class of devices just described. It is characterized by a cap provided with expandible and contractible jaws which serve the purpose of the crimp on a crown cap but which may be reused repeatedly. Further, the cap is provided with a pivoted lever for contracting or expanding the jaws, the lever being provided with an opener for prying the original cap from the neck of the container. When in one position the cap forms an extension of the lever to add leverage thereto for prying off the original cap. After removal of the original cap, swinging movement of the lever collapses the jaws and effects the seal. When it is desired to remove the cap the lever is swung to its former position which releases the jaws from the ridge surrounding the container neck. The lever thus serves the two-fold purpose of sealingly applying the cap in a locked condition and for unlocking and removing same from the neck. Additionally, it serves the purpose of a cap remover, aided in its leverage by the cap. Also, when in sealing position the entire device occupies a space within the container overall envelope, usually cylindrical, which facilitates storage in a refrigerator, compartmented carton or other place of repose where saving of space is advantageous or desirable.

A general object of the invention, accordingly, is to provide improvements in a combined crown cap remover and bottle neck closure.

Another object is to employ the device for either of the separate foregoing purposes but usually for both purposes in sequence.

Another object is to provide a device which may be mass produced from punched and bent sheet metal which may be mass produced at relatively low cost to thus render it available to all potential users thereof.

A still further object is to provide a device which is compact when in its folded condition to conserve space when in either use or nonuse.

Still further objects will become more apparent from the detailed description to follow, the appended claims, and the accompanying drawing to now be briefly described.

DETAILED DESCRIPTION OF PREFERRED EMBODIMENT

General

Figure 1:
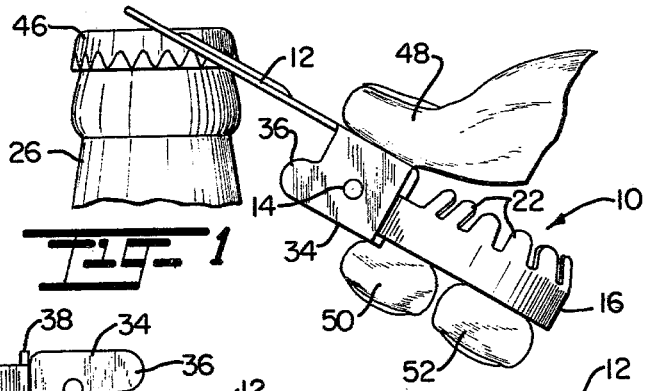
FIG. 1 is a side elevation of the subject of the invention, illustrating an initial position in the removal of a conventional crown cap from a container neck.
Figure 2:
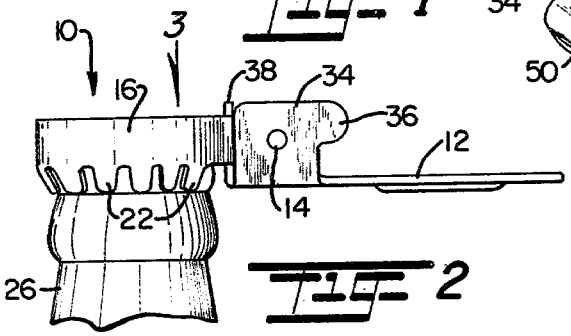
FIG. 2 is a side elevation illustrating the initial positioning of a replacement cap or closure portion of FIG. 1 on the container neck.
Figure 4:
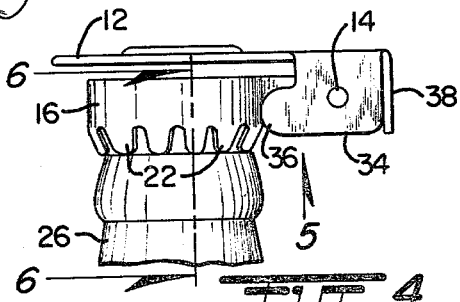
FIG. 4 is a side elevation of the position of parts after the replacement cap has been secured and sealed on the container neck.
Figure 3:
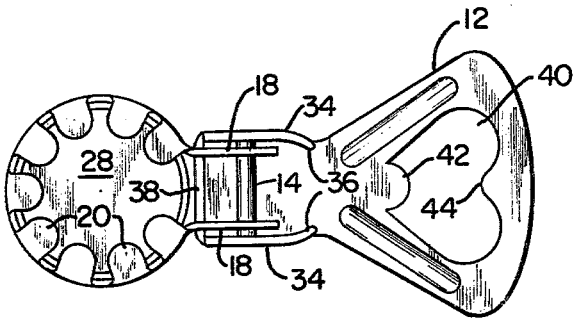
FIG. 3 is a top plan as viewed in the direction of arrow 3, FIG. 2.
Figure 5:
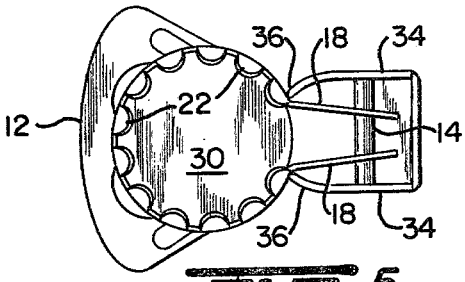
FIG. 5 is a lower plan, as viewed in the direction of arrow 5, FIG. 4.

Referring now in detail to the drawing, and first to FIGS. 1–6, the subject of the invention comprises, in general, a container neck closure 10, a combined lever and bottle cap opener 12, and a pin 14, pivotally connecting the closure and lever together for relative pivotal movement between limit positions substantially 180° apart. As shown in FIGS. 1, 2 and 3, the closure 10 and lever 12 are in one limit position while in FIGS. 4 and 5 they are in their other limit position.

The Closure or Cap

Figure 6:
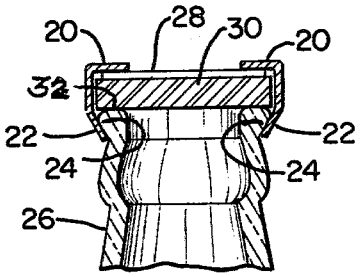
FIG. 6 is a section taken on line 6—6, FIG. 4.
Figure 7:
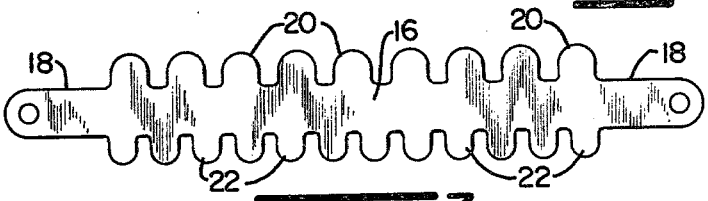
FIG. 7 is a plan of the closure blank or punching prior to bending to final shape.

Closure 10 is blanked from sheet metal, as shown in FIG. 7, and thence bent, as best shown in FIGS. 1–6, to provide a circular peripheral band 16, wings 18,18 at the ends thereof, tabs 20 adjacent the top edge thereof bent normal to the band, and jaws 22 adjacent the lower edge thereof bent at about 60° to the axis of the band which cammingly engage ridge 24 on container neck 26, as best shown in FIG. 6. A circular disk 28 abuts tabs 20 and a soft gasket 30 abuts same at its upper face, its lower face engaging annular end 32 on the bottle neck. As will be apparent, when wings 18 are moved toward each other, band 16 moves radially inwardly, jaws 22 cammingly engaging ridge 24, moving the closure axially downwardly, which, compresses gasket 30 against annular end 32, forming a seal thereat. In similar manner, when the wings are moved away from each other, jaws 22 move radially outwardly away from ridge 24, permitting removal of the closure from the container neck.

Lever and Cap Remover

Figure 8:
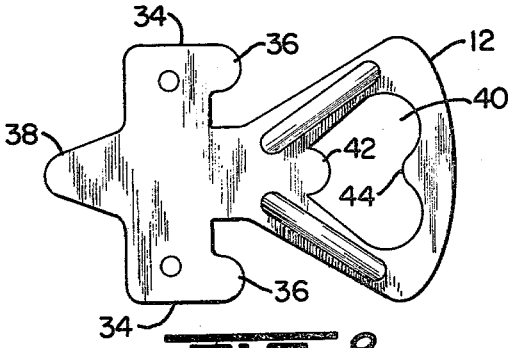
FIG. 8 is a plan of the lever and cap opener blank or punching prior to bending to final shape.

Lever 12 is also blanked from sheet metal, as shown in FIG. 8, and thence bent, as best shown in FIGS. 1–6, to provide a pair of parallel flat portions 34,34 disposed normal to the plane of the blank. End portions 36,36 are bent toward each other to provide cams for engaging opposite outer surfaces of wings 18,18 for moving same toward each other when the lever is pivoted from the position shown in FIGS. 2 and 3 to the position shown in FIGS. 4 and 5, when in the position of FIGS. 4 and 5, the wings remain locked thereat preventing unauthorized retrograde movement of the lever.

A third cam 38, generally isoceles triangular shaped, is formed by bending it normal to the plane of the lever and is disposed, as best shown in FIG. 3, between the inner faces of wings 18,18. When in such position, it spreads the wings apart to their outward limit, thus opening the jaws to permit application of the closure to the closure neck or removal therefrom. While cams 36,36 are essential for moving wings 18,18 toward each other, cam 38 may be optionally employed for moving them away from each other, since the peripheral portion 16 is resilient and tends to expand to release the jaws.

Lever 12 is also provided with a cut-out 40 and tabs 42,44 extending into the cut out space. As illustrated in FIG. 1, tab 42 may engage beneath the bottom edge of original crown cap 46, tab 44 engaging its top surface at about its mid-point. When in this position it may distort and pry the crown cap from ridge 24 in the same manner as a conventional crown cap remover. FIG. 1 illustrates one manner of holding the device in which a thumb 48 is disposed on one side of the lever and a index finger 50 and middle finger 52 are disposed at the other side, at least one of the latter being in engagement with the closure which forms an extension of the lever, providing increased leverage to pry off the conventional crown cap.

What I claim is:

1. In a replacement closure for use on the end of a container neck, such as that of a bottle having an annular end against which an original closure cap gasket is adapted to sealingly engage and a ridge surrounding the neck adapted to be engaged by the original cap, such as a crown or threaded cap, for maintaining the original closure cap in its sealing engagement, comprising; a cup shaped member including a circular band portion adapted to extend partially around the outer end of said neck having a plurality of angular spaced jaws for engaging said ridge and having a gasket therein for sealingly engaging said annular end of the neck when the jaws are moved radially inwardly, said band portion terminating in a pair of generally parallel outwardly projecting spaced wings adapted to be moved toward and away from each other, the jaws adapted to engage the ridge when moved toward each other and effect sealing by the gasket and adapted to release engagement of the jaws from the ridge when moved away from each other, a lever having one end pivotally connected to the wings and swingable between a first limit position extending outwardly from the wings, and a second limit position in which its other end lies on top of the cup-shaped member, the lever having a pair of cams engagable with outwardly facing portions of the wings for moving same toward each other when the lever is swung toward its second limit position and for locking same against retrograde movement, the improvements, in combination, comprising;

(a) said jaws being bent angularly inwardly to cammingly engage beneath said annular end, (b) said spaced wings being flat, (c) said lever being blanked from flat sheet metal with parallel spaced bends normal to the blank, and pivotally connected to the wings, the spaced bends having projections therefrom bent angularly inwardly toward each other, their terminal ends being engagable with the flat wings immediately adjacent their junctures with the band portion, (d) said lever including: a third cam formed as a bend normal to the plane of the blank at one end thereof engagable with inwardly facing portions of the flat wings adjacent their junctures with the band portion for moving same away from each other when the lever is swung toward its first limit position to aid in removal of the replacement closure from the container.

2. A closure in accordance with claim 1 wherein the third cam includes edges tapering toward each other in the direction of the blank.

3. A closure in accordance with claim 2 wherein the third cam is shaped as an isosceles triangle with a rounded apex disposed centrally between the flat wings.

* * * * *